United States Patent [19]

Kirk

[11] Patent Number: 4,956,889

[45] Date of Patent: Sep. 18, 1990

[54] PORTABLE DRAIN CLEANING APPARATUS

[75] Inventor: Karl L. Kirk, Elyria, Ohio

[73] Assignee: Emerson Electric Co., St. Louis, Mo.

[21] Appl. No.: 374,842

[22] Filed: Jul. 3, 1989

[51] Int. Cl.[5] ..... B08B 9/02

[52] U.S. Cl. ..... 15/104.33; 254/134.3 FT

[58] Field of Search ..... 15/104.33; 254/134.3 FT; 226/143

[56] References Cited

U.S. PATENT DOCUMENTS

| | | | |
|---|---|---|---|
| 2,245,823 | 6/1941 | Rappaport | 15/104.33 |
| 2,318,172 | 5/1943 | Long | 15/104.33 |
| 2,661,489 | 12/1953 | Rudolph et al. | 15/104.33 |
| 2,769,191 | 11/1956 | Hunt et al. | 15/104.33 |
| 3,691,583 | 9/1972 | Silverman et al. | 15/104.33 |
| 3,897,602 | 8/1975 | Waterbury | 15/104.33 |
| 4,218,802 | 8/1980 | Babb et al. | 15/104.33 |
| 4,361,924 | 12/1982 | Irwin | 15/104.33 |
| 4,706,321 | 11/1987 | Kaye | 15/104.33 |

*Primary Examiner*—Harvey C. Hornsby
*Assistant Examiner*—G. Graham
*Attorney, Agent, or Firm*—Body, Vickers & Daniels

[57] ABSTRACT

An improved hand held drain cleaning apparatus is disclosed which is of the type employing a flexible snake which is rotated and inserted into a waste line to remove blockage. The apparatus includes a housing in which the sanke is coiled and a guide tube extending from the housing and through which the snake passes for insertion into a waste line. A manually actuated sleeve assembly is provided on the guide for displacing resilient spring finger clamping elements into engagement with the snake to hold the snake against axial displacement relative to the housing during insertion and/or removal of the snake from the waste line and to clamp the snake against rotation relative to the guide tube and the housing during the drain cleaning operation. The sleeve assembly is removably retained on the guide tube, and the spring finger elements, the guide tube and the sleeve assembly engage with one another to alone removably support the spring finger clamping elements against axial and circumferential displacement relative to and radial separation from the guide tube. Upon removal of the tubular hand grip, the spring finger gripping elements are released for separation from the guide tube.

36 Claims, 4 Drawing Sheets

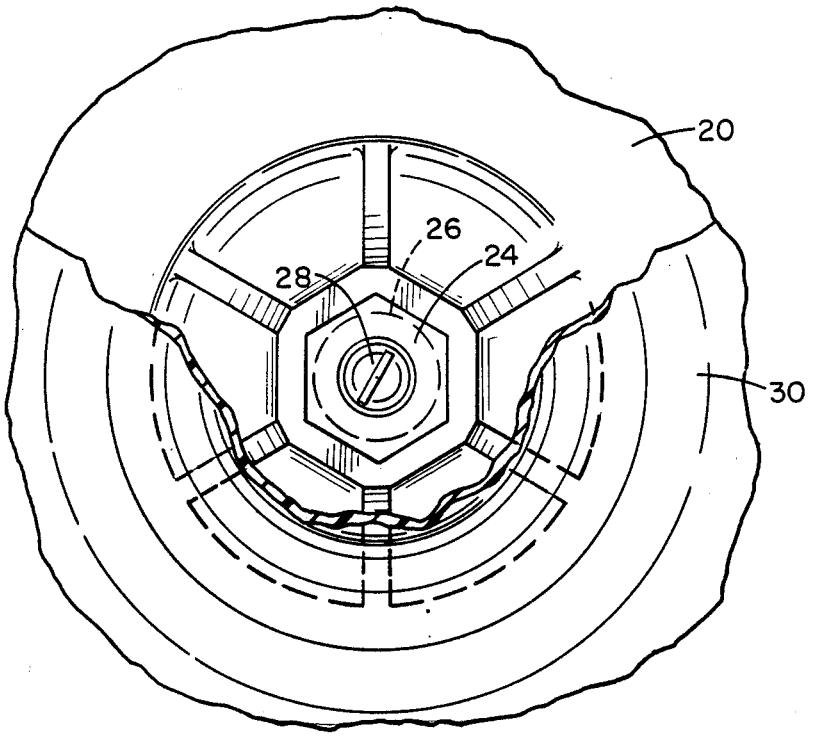
FIG. 3
FIG. 4
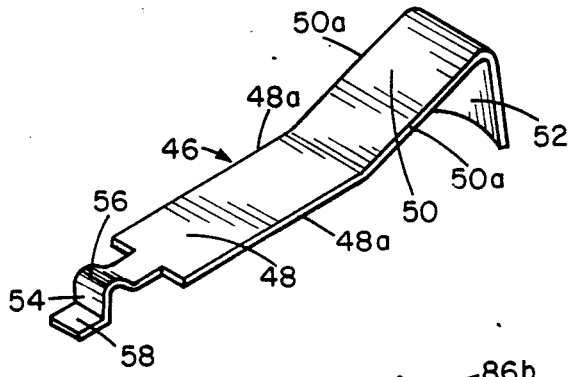
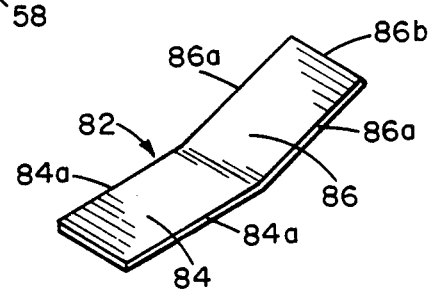
FIG. 5

PORTABLE DRAIN CLEANING APPARATUS

BACKGROUND OF THE INVENTION

This invention relates to apparatus for cleaning a drain pipe or waste line and, more particularly, to hand held apparatus for feeding a flexible snake into a waste line and rotating the snake so as to clear an obstruction or blockage in the line.

The present invention finds particular utility in connection with portable motor driven flexible snake-type drain cleaning apparatus of the character in which the snake is clamped during feeding and is rotated by a hand held, trigger actuated motor, such as shown for example in U.S. Pat. Nos. 3,691,583 to Silverman et al. and 4,218,802 to Babb et al. Accordingly, the invention will be described in detail hereinafter in conjunction with such apparatus. At the same time, however, it will be appreciated that the invention is applicable to other drain cleaning apparatus in which a clamping arrangement is provided to hold the snake against axial displacement relative to the apparatus during movement of the snake into and out of a waste line.

Typically, such drain cleaning apparatus of the character disclosed in the above patents is comprised of a hand held, trigger actuated motor drivingly connected to a housing for rotating the housing about a longitudinal axis. The housing is provided with a guide tube opening thereinto coaxial with the axis of rotation and through which extends a flexible snake which is coiled within the housing or in a snake cartridge removably supported in the housing for rotation therewith. As shown in the patent to Silverman et al., the snake cartridge can be removable to facilitate connecting successive snakes for feeding into a waste line, or for using different diameter snakes with the apparatus. The snake, as is conventional, is an elongate, flexible member made of tightly wound spring wire, and the end thereof extending through the guide tube is adapted to be manually pulled from or pushed back into the housing where it is stored during periods of non-use. A hand grip sleeve arrangement surrounds the guide tube and is rotatable and axially displaceable relative thereto to effect the displacement of snake clamping elements into engagement with the snake to preclude axial displacement of the snake relative to the guide tube and housing during displacement of the rotating snake into a waste line. The clamping elements also apply additional holding force to preclude rotation of the snake relative to the guide tube during the drain cleaning operation.

Apparatus of the foregoing character heretofore provided have been comprised primarily of metal parts, whereby replacement of certain parts of the apparatus is frequently required as a result of the corrosive nature of the liquid and solid waste materials encountered by the snake during use of the apparatus. Moreover, snake clamping arrangements such as that shown in the patent to Babb et al. are structurally complex and expensive and, while the spring finger snake gripping arrangement shown in the patent to Silverman et al. provides a more economical approach, the component parts in the Silverman et al. apparatus are adversely affected by corrosion and undesirably stressed during use, thereby promoting frequent replacement of the spring finger elements. More particularly in this respect, the snake gripping spring fingers in the patent to Silverman et al. are secured to the metal guide tube by threaded fasteners which, as the result of corrosion, can break or otherwise become extremely difficult if at all possible to remove in connection with replacing the spring fingers. Furthermore, the threaded fastener in the Silverman et al. arrangement extends through an opening in the spring finger element which is immediately adjacent the bending point for the spring finger, whereby considerable stress is placed on the spring finger both at the bending point and at the point of connection which is weakened by the opening for the fastener. It will be appreciated that both of these factors disadvantageously affect the fatigue life of the spring finger element.

SUMMARY OF THE INVENTION

In accordance with the present invention, drain cleaning apparatus is provided with a hand grip actuated snake clamping arrangement including spring finger type snake clamping elements structurally interrelated with the guide tube and hand grip sleeve arrangement of the apparatus in a manner which enables obtaining the desired economical features of a spring finger arrangement while avoiding the problems referred to hereinabove in connection with the mounting, replacement and fatigue life thereof. More particularly in accordance with the invention, spring finger snake clamping elements are axially, circumferentially and radially retained relative to the tubular guide portion of the apparatus merely by engagement between the spring fingers, guide tube and hand grip sleeve arrangement, and without the use of any fastener elements. Therefore, when it becomes necessary to replace the spring fingers there is no potential problem of a frozen or deteriorated fastener element resulting from corrosion. Moreover, structural integrity of the spring finger element is optimized by avoiding any openings therethrough for fastener elements. Further, in accordance with one aspect of the invention, the spring fingers are structured and the components parts interengage with one another in a manner whereby the force of displacement of the snake clamping end or jaw of the spring fingers is distributed between the opposite ends of the spring finger so as to reduce the stresses imposed thereon and thus increase the fatigue life thereof.

Preferably, each spring finger is axially positioned relative to the guid tube by a tab arrangement on one end of the spring finger and a slot therefor in the guide tube, and by the clamping jaw portion of the spring finger and an opening therefor through the guide tube. The preferred tab and slot engagement between the spring finger and guide tube further supports the corresponding end of the spring finger against radial displacement outwardly of the guide tube, and radial positioning of the spring finger relative to the guide tube is further achieved by a removable hand grip sleeve assembly which overlies a portion of the spring finger. The tab and slot engagement between the spring finger and guide tube further facilitates the ease of removal and replacement of the spring finger. In this respect, when the hand grip sleeve assembly is removed from the guide tube, the spring finger is removable merely by pivoting the spring finger radially outwardly relative to the tab and slot and then radially withdrawing the tab from the slot. Replacement of the spring finger is likewise easily achieved by inserting the tab of the spring finger radially through the slot in the guide tube and then pivoting the spring finger radially inwardly against the guide tube and then remounting the hand grip assembly to radially capture the spring finger against the guide tube. Preferably, the spring finger is received in an axially extending recess in the outer surface of the guide tube so that the side edges of the spring finger and the side walls of the recess engage to position the spring finger circumferentially of the guide tube.

It is accordingly an outstanding object of the present invention to provide an improved spring finger type snake clamping arrangement for power driven drain cleaning apparatus.

Another object is the provision of a clamping arrangement of the foregoing character wherein spring finger clamping elements are removably supported on a tubular guide portion of the apparatus without the use of mechanical fasteners.

A further object is the provision of a clamping arrangement of the foregoing character in which the structural integrity and fatigue life of the spring finger clamping elements are optimized.

Still another object is the provision of a clamping arrangement of the foregoing character in which the spring finger clamping elements, guide tube and hand grip sleeve assembly of the apparatus are structured and structurally interrelated to alone support the spring fingers against axial and circumferential displacement relative to and radial separation from the guide component.

Still a further object is the provision of a clamping arrangement of the foregoing character which promotes reducing the frequency of required replacement of the spring finger clamping elements, reduces the time and effort required to remove and replace the spring finger elements, and minimizes fatigue stressing of the spring finger elements during use, all while maintaining the structural integrity of the component parts necessary to achieve the snake clamping function over long periods of use of the apparatus.

BRIEF DESCRIPTION OF THE DRAWINGS

The foregoing objects, and others, will in part be obvious and in part pointed out more fully hereinafter in connection with the description of preferred embodiments of the invention shown in the accompanying drawings in which:

FIG. 3 is a cross-sectional elevation view taken along line 3—3 in FIG. 1;

FIG. 4 is a perspective view of the spring finger clamping element of the apparatus;

FIG. 5 is a perspective view of a booster spring finger element;

DESCRIPTION OF PREFERRED EMBODIMENTS

Figure 1:
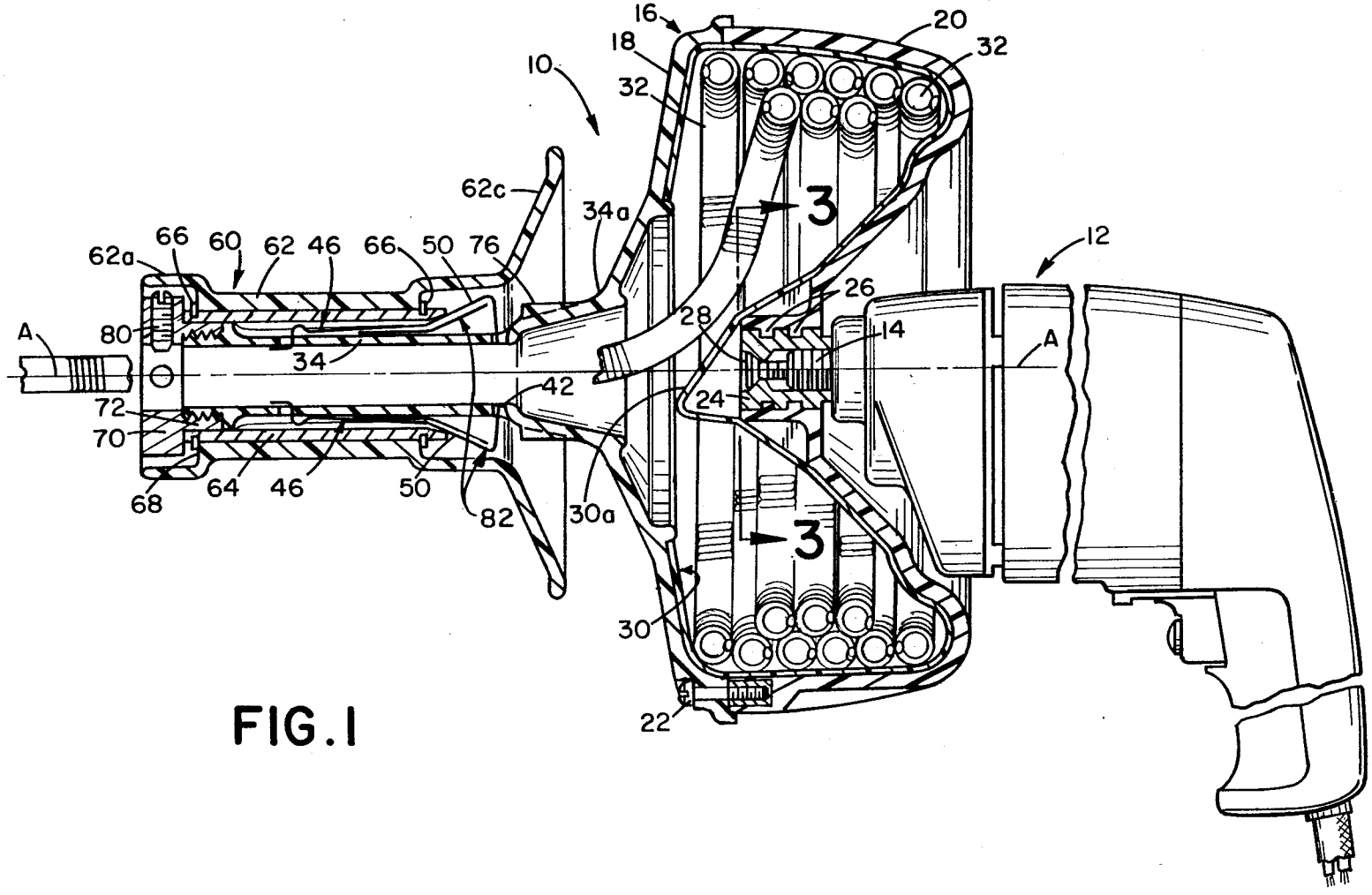
FIG. 1 is a sectional elevation view of drain cleaning apparatus including a snake clamping arrangement in accordance with the present invention.

Referring now in greater detail to the drawings, wherein the showings are for the purpose of illustrating preferred embodiments of the invention only and not for the purpose of limiting the invention, drain cleaning apparatus in accordance with the invention is shown in FIG. 1 and designated generally by the numeral 10. In the embodiment disclosed, drain cleaning apparatus 10 is attached as described more fully hereinafter to a trigger actuated drive motor unit 12 which may, for example, be an electric drill motor and, preferably, is a reversible, variable speed electric motor. Motor 12 includes an output shaft 14 having an axis of rotation A which, as will become apparent hereinafter, coincides with the axis of drain cleaning apparatus 10.

Drain cleaning apparatus 10 includes a housing 16 coaxial with axis A and comprised of front and rear housing portions 18 and 20, respectively, releasably interengaged by a plurality of threaded fasteners 22 spaced apart about the periphery thereof, as will be appreciated from one such fastener shown in FIG. 1. Housing portions 18 and 20 are preferably made of plastic material, and rear housing portion 20 as shown in FIGS. 1 and 3 is provided with a hexagonal opening receiving a correspondingly contoured hexagonal metal coupling insert 24 by which the drain cleaning apparatus is attached to motor shaft 14. The hexagonal contours of the opening and insert prevent relative rotation between the insert and housing and, preferably, the insert is molded in place in the opening therefor and is provided with a pair of grooves 26 extending about the outer periphery thereof and receiving the plastic material of rear housing portion 20 to interengage the housing and insert against relative axial displacement. Apparatus 10 is removably mounted on drive shaft 14 and, in this respect, insert 24 is axially bored and internally threaded for threaded engagement with external threads on motor shaft 14, not designated numerically. Preferably, the outer end of insert 24 is bored to receive a retaining bolt 28 which threadedly interengages an internally threaded bore in the outer end of motor shaft 14. If an electric drill motor is used for the power unit, the externally threaded drive shaft and the internally threaded bore therein receiving fastener 28 are, generally, existing features used to removably mount the drill chuck on the drive shaft, whereby the drive arrangement shown does not require any modification of the power unit.

Housing 16 removably receives a snake cartridge 30 contoured to correspond to the interior of the housing and which is removable therefrom when housing portions 18 and 20 are separated by removing fasteners 22 therebetween. Cartridge 30 contains a flexible, drain cleaning snake 32 coiled therein and thus in housing 16 about axis A, and the cartridge is suitably interengaged with housing 16 for rotation therewith about axis A. Such interengagement can be achieved in any suitable manner such as by slightly oversizing the cartridge relative to the interior of the housing for the cartridge to snugly fit therein, or by providing interengaging recess and projection means between one of the housing portions and the cartridge to interengage the cartridge against rotation relative to the housing. The use of a removable cartridge advantageously enable using the apparatus with different diameter snakes, or extending the effective length of a snake of given diameter which has been fully expended from the apparatus. Preferably cartridge 30 includes an inner end wall portion **30*a* which extends across axis A at an inclined angle relative thereto so as to promote lateral deflection of snake 32** as the latter is pushed axially into the cartridge.

Figure 2:
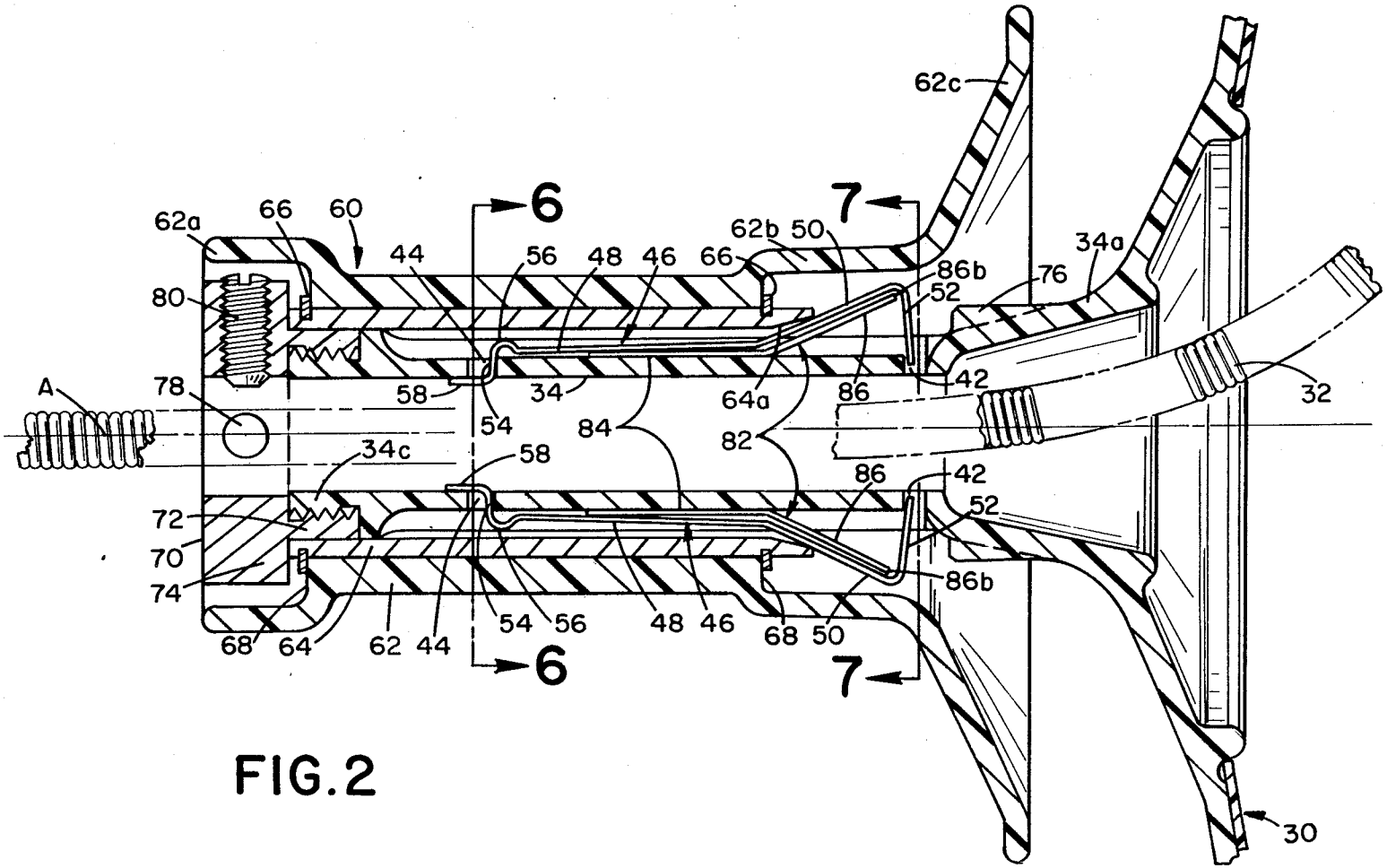
FIG. 2 is an enlarged sectional elevational view of the snake clamping portion of the apparatus shown in FIG. 1.
Figure 6:
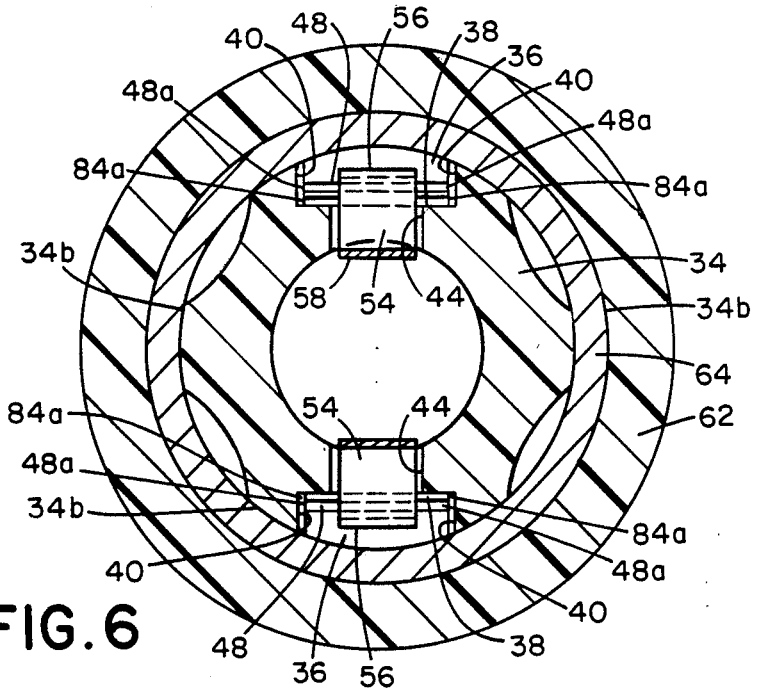
FIG. 6 is a cross-sectional elevational view taken along line 6—6 in FIG. 1; and, FIG. 7 is a cross-sectional elevational view taken along line 7—7 in FIG. 1.
Figure 7:
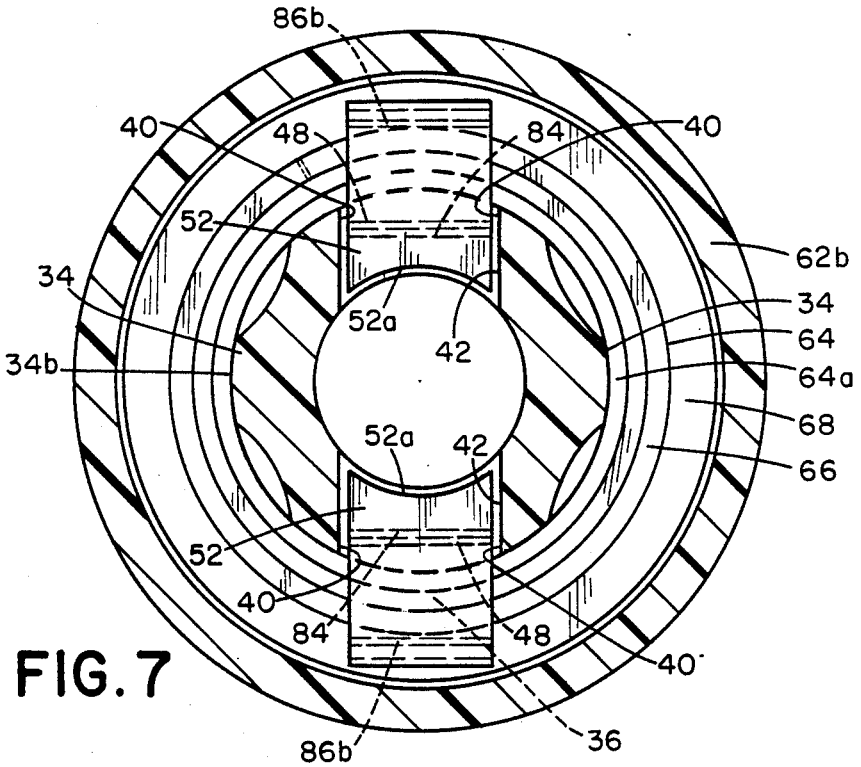

As best seen in FIGS. 1 and 2, apparatus 10 further includes an annular guide tube 34 extending forwardly from front housing portion 18 coaxial with axis A and which, preferably, is made of plastic material and molded integral with housing portion 18. The axially inner end 34a of guide tube 34 opens into housing 16, and the interior of the guide tube provides a passageway through which snake 32 extends during a drain cleaning operation. As will be seen from FIGS. 6 and 7 of the drawing, guide tube 34 is longitudinally fluted, for the purpose set forth hereinafter, and the outer surface of the guide tube is provided with diametrically opposed axially extending recesses 36. Each recess 36 includes a planar bottom wall 38 parallel to axis A and opposed axially extending side walls 40. The axially inner end of each recess is provided with an opening 42 extending radially through the guide tube to the interior thereof, and each recess is further provided with a slot 44 spaced axially outwardly from opening 42 and extending radially through the guide tube to the interior thereof.

Each recess 36 receives a corresponding spring finger snake clamping element 46 of suitable spring metal such as AISI 302 or 304 spring tempered stainless steel, for example. As will be appreciated from FIGS. 2 and 4, clamping element 46 includes a first planar leg 48 extending axially along bottom wall 38 of the corresponding recess and a second planar leg 50 extending radially outwardly from bottom wall 38 at an inclined angle with respect to the guide tube and axis A. Legs portions 48 and 50 have corresponding laterally opposite side edges 48a and 50a which engage against a corresponding side wall 40 of recess 36 to laterally position the spring finger clamping elements 46 against circumferential displacement relative to the guide tube. Leg 50 terminates in a radially inwardly extending snake clamping jaw 52 which, in its released position as shown in FIG. 2, extends into opening 42 and, preferably, has an arcuate inner end 52a for engagement with the snake extending through the guide tube. The axially outer end of first leg 48 terminates in a tab arrangement which interengages with guide tube 34 to position the spring finger element axially relative to the guide tube and to retain the axially outer end of the spring finger against radial separation from the guide tube. The tab arrangement includes a first tab 54 connected to leg 48 by a relatively large radius bend 56 and extending radially inwardly through slot 44. Bend 56 is provided to avoid a sharp bend between the leg and tab which might undesirably stress the material of the spring finger in the bend area. The tab arrangement further includes a second tab 58 extending axially outwardly from the radially inner end of tab 54 and engaging the inner surface of guide tube 34. Tab 54 in slot 44 and jaw 52 in opening 42 preferably engage the axially inner and axially outer edges of the slot and opening, respectively, to preclude any axial displacement of the spring finger element relative to the guide tube.

Drain cleaning apparatus 10 further includes a hand grip sleeve assembly 60 comprising an outer hand grippable sleeve member 62, preferably of plastic material, and an inner bearing sleeve 64, preferably of stainless steel. Sleeves 62 and 64 are coaxial with axis A and rotatable relative to one another and are interengaged against relative axial displacement therebetween by means of a pair of retaining rings 66 engaged in axially spaced apart circumferential recesses in bearing sleeve 64, not designated numerically. Retaining rings 66 engage against the corresponding one of shoulders 68 on the radially inner side of outer sleeve 62. Sleeve assembly 60 is axially slidably received on guide tube 34 and is supported thereon for axial displacement and for rotation relative thereto by outer surface portions 34b of the fluted outer surface of the guide tube. The fluted outer surface of the guide tube advantageously enables reducing the area of frictional contact between the bearing sleeve and guide tube. The axially inner end 64a of bearing sleeve 64 preferably is chamfered for the purpose which will become apparent hereinafter and, in the snake released positions of the jaws 52 shown in FIG. 2, end 64a preferably is contiguous with the outer surfaces of second legs 50 of the spring finger clamping elements, whereby sleeve assembly 60 cooperates with tabs 58 on the spring finger elements to support the spring finger elements against radial separation from guide tube 34.

Hand grip sleeve assembly 60 is removable as a unit from guide tube 34 and is axially retained thereon by means of an annular nose piece 70, preferably of metal, having an axially inwardly extending annular wall 72 internally threaded for engagement with external threads on axially outer end 34c of guide tube 34. Nose piece 70 has a radially outwardly extending circumferential flange 74 against which the axially outer end of bearing sleeve 64 engages to limit axial outward displacement of sleeve assembly 60 relative to guide tube 34, and the axially inner end 34a of the guide tube is provided about the periphery thereof with stops 76 radially positioned to engage the axially inner end of bearing sleeve 64 to limit axial inward displacement of sleeve assembly 60 relative to guide tube 34. Nose piece 70 is provided with a pair of diametrically opposed openings 78 therethrough, only one of which is seen in FIG. 2, and which openings are adapted to receive a suitable rod element to facilitate loosening or tightening of the nose piece relative to guide tube 34. Nose piece 70 is further provided with a radially extending internally threaded opening receiving a set screw 80 for the purpose set forth hereinafter.

The axially outer end of outer hand grip sleeve 62 is provided with a skirt portion 62a extending axially outwardly across nose piece 70 when the sleeve assembly is in its axially outermost position on the guide tube, and the axially inner end of sleeve 62 is provided with a skirt portion 62b which extends axially across and radially accommodates legs 50 of spring finger elements 46 when the sleeve assembly is in its axially outermost position. Sleeve 62 is further provided with a flared skirt portion 62c extending rearwardly from skirt portion 62b and which is generally parallel to and spaced axially forward of the corresponding portion of front housing member 18 when sleeve assembly 60 is in its axially outermost position. Skirt portions 62a, 62b and 62 c are protective with respect to a user's hand in gripping and manipulating outer sleeve 62 during operation of the apparatus, and skirt portion 62b further serves to protect the spring fingers from damage when sleeve assembly 60 is in its axially outermost position.

Preferably, for the purpose set forth hereinafter, the return bias against jaws 52 of the snake clamping spring finger elements 46 is supplemented by booster spring finger elements 82 of the same spring metal material as spring fingers 46 and which, as best seen in FIG. 5, include a first planar leg 84 and a second planar leg 86 inclined at an angle to leg 84 corresponding generally to the angle between first and second legs 48 and 50 of spring finger elements 46. Booster spring finger elements 82 are generally the same width as legs 48 and 50 of spring finger elements 46, and legs 84 and 86 of the booster elements have corresponding opposite side edges 84a and 86a, respectively. As best seen in FIG. 2, leg 84 radially underlies first leg 48 of the coresponding spring finger element 46 and leg 86 radially underlies second leg 50 of the corresponding spring finger element. Further, end edge 86*b* of leg 86 is disposed closely adjacent the bend between leg 50 and jaw 52, whereby the booster spring element is axially positioned relative to the guide tube and to spring finger element 46 by the latter, is radially positioned by the spring finger element, and is circumferentially positioned by engagement of side edges 84*a* and 86*a* of legs 84 and 86 with side walls 40 of the corresponding recesses 36.

With the component parts of the apparatus in the snake released positions thereof shown in FIGS. 1 and 2, and presuming a portion of snake 32 to have been withdrawn from housing 16 through guide tube 34 and inserted in a waste line to be cleaned, the user grasps hand grip sleeve 62 in one hand and motor 12 in the other whereby, upon energization of drive motor 12, housing 16, guide tube 34, spring finger clamping elements 46 and snake 32 rotate about axis A relative to sleeve 62 and motor 12. As the user displaces hand grip sleeve assembly 60 rearwardly toward housing 16, chamfered end 64*a* of bearing sleeve 64 displaces spring finger legs 50 so as to move jaws 52 of the spring finger elements radially inwardly into snake clamping positions engaging snake 32. Such clamping engagement with the snake promotes continued rotation of the snake with housing 16 and guide tube 34 should the snake encounter an obstruction in the waste line tending to stop rotation of the snake. Further, such clamping precludes axial displacement of the snake relative to the housing and guide tube enabling the user to move the snake either into or out of the waste line. Should an obstruction be encountered in the waste line which overcomes the ability of the spring clamping finger elements to restrain relative rotation between the snake and the housing and guide tube, set screw 80 can be screwed radially inwardly so as to positively clamp the snake against nose piece 70 so that the snake rotates with housing 16 and guide tube 34.

When the user wants to extract more snake from housing 16, or retract the snake thereinto, hand grip sleeve assembly 60 is displaced forwardly of housing 16 to the position shown in FIGS. 1 and 2, whereby the resiliency of the material of spring finger clamping elements 46 returns leg portions 50 and jaws 52 thereof to the snake released positions shown in FIGS. 1 and 2. When the jaws 52 are in the snake clamping positions thereof, the radially inner ends of the jaws penetrate the snake convolutions, whereby the resiliency of the spring metal must be sufficient to overcome the axial grip of the snake convolutions on the jaws 52 to return the jaws to the snake released position when sleeve assembly 60 is returned to the position shown in FIGS. 1 and 2. While the thickness of the spring material of the spring finger clamping element can be sufficient to assure the force necessary to provide such separation of jaws 52 form the snake, it is preferred as shown herein to use the booster spring elements 82 to provide the return force in tandem with the resiliency of the material of spring finger elements 46. In this respect, the use of booster spring elements 82 enables provides a given return force with thinner spring metal for elements 46 than would be required to provide the same force using the spring finger clamping elements 46 alone. This, advantageously, enables increasing the fatigue life of the spring finger clamping elements relative to that which would be obtained with thicker spring material.

Further in connection with the fatigue life of the spring finger clamping elements, it will be appreciated from FIG. 2 that the juncture between first and second legs 48 and 50 of the spring finger clamping elements provides a fulcrum relative to which legs 48 and 50 and jaws 52 are displaced in response to axial movement of sleeve assembly 60 relative to the spring finger elements. More particularly in this respect, during movement of sleeve assembly 60 toward housing 16 to displace jaws 52 radially inwardly to engage snake 32, tabs 58 engage the inner side of guide tube 34 to resist radial outward displacement of the outer ends of spring finger elements 46, and first legs 48 of the spring finger elements bow radially outwardly in recesses 36 between the axially outer ends of the spring finger elements and the fulcrum point. This bowing advantageously minimizes the stresses imposed on the spring elements in the bend area between legs 48 and 50, and distributes the forces along the spring finger elements so as to further increase the fatigue life of the elements.

When it is desired to remove the spring finger clamping elements for cleaning or replacement, all that is necessary is to unscrew nose piece 70 from guide tube 34 and slide hand grip sleeve assembly 60 axially forwardly off of the guide tube. Spring finger clamping elements 46 are then exposed and are readily removed simply by pivoting the elements radially outwardly of guide tube 34 relative to the tabs and tab slots 44 and withdrawing the tabbed ends radially outwardly through slots 44. Replacement of the spring finger elements is likewise readily achieved simply by introducing tabs 58 through openings 44 and then pivoting the spring finger elements toward guide tube 34 to the positions shown in FIG. 2. Sleeve assembly 60 is then moved axially onto guide tube 34 to radially capture the spring fingers relative thereto, and nose piece 70 is threaded onto the outer end of the guide tube to complete the assembly operation.

While considerable emphasis has been placed on the preferred embodiment herein illustrated and described, it will be appreciated that other embodiments of the invention can be made and that many changes can be made in the embodiment disclosed without departing from the principles of the present invention. Accordingly, it is to be distinctly understood that the foregoing descriptive matter is to be interpreted merely as illustrative of the invention and not as a limitation.

Having thus described the invention, it is claimed:

1. In a drain cleaning apparatus comprising tubular guide means having an axis, snake means extending through said guide means, means to rotate said guide means about said axis, spring finger means rotatable with said guide means and including jaw means displaceable toward and away from said snake means between clamping and released positions relative thereto, and sleeve means removably received on said guide means and being axially displaceable relative thereto to actuate said spring finger means to displace said jaw means between said positions thereof, the improvement comprising: said spring finger means, said guide means and said sleeve means including means engaging with one another to alone support said spring finger means against axial and circumferential displacement relative to and radial separation from said guide means, said means engaging with one another including inner surface means on said sleeve means radially capturing said spring finger means between said guide means and sleeve means, whereby said sleeve means when removed from said guide means releases said spring finger means for free radial separation from said guide means.

2. In a drain cleaning apparatus comprising tubular guide means having an axis, snake means extending through said guide means, means to rotate said guide means about said axis, spring finger means rotatable with said guide means and including jaw means displaceable toward and away from said snake means between clamping and released positions relative thereto, and sleeve means received on said guide means and being axially displaceable relative thereto to actuate said spring finger means to displace said jaw means between said positions thereof, the improvement comprising: said guide means including opening means radially therethrough and said spring finger means including tab means extending through said opening means, said spring finger means, said guide means and said sleeve means including means engaging with one another to alone support said spring finger means against axial and circumferential displacement relative to and radial separation from said guide means and, said means engaging with one another including said tab means engaging said guide means in said opening means to support said spring finger means against axial displacement relative to said guide means.

3. Drain cleaning apparatus according to claim 2, wherein said sleeve means is removably received on said guide means, said means engaging with one another including surface means on said sleeve means engaging said spring finger means to radially capture said spring finger means against said guide means, said sleeve means when removed from said guide means releasing said spring finger means for free radial separation from said guide means.

4. Drain cleaning apparatus according to claim 3, wherein said guide means has an inner surface, and said tab means includes a first tab portion spaced from said jaw means and extending radially through said opening means and a second tab portion extending axially from said first tab portion away from said jaw means and along said inner surface, said means engaging with one another including said second tab portion engaging said inner surface of said guide means to support said spring finger means against displacement radially outwardly of said guide means.

5. Drain cleaning apparatus according to claim 2, wherein said guide means includes jaw opening means radially therethrough, said jaw means extending into said jaw opening means, and said means engaging one another including said jaw means engaging said guide means in said jaw opening means to support said spring finger means against axial displacement relative to said guide means.

6. Drain cleaning apparatus according to claim 5, wherein said sleeve means is removably received on said guide means, said means engaging with one another including surface means on said sleeve means engaging said spring finger means to radially capture said spring finger means against said guide means, said sleeve means when removed from said guide means releasing said spring finger means for free radial separation from said guide means.

7. Drain cleaning apparatus according to claim 6, wherein said tubular guide means has an inner surface, and said tab means includes a first tab portion spaced from said jaw means and extending radially through said opening means and a second tab portion extending axially from said first tab portion away from said jaw means and along said inner surface, said means engaging with one another including said second tab portion engaging said inner surface of said guide means to support said spring finger means against displacement radially outwardly of said guide means.

8. Drain cleaning apparatus according to claim 1, wherein said spring finger means has axially opposite ends and axially extending side edges and said guide means has an outer surface including axially extending recess means receiving said spring finger means and having side walls receiving said side edges of said spring finger means therebetween, said means engaging with one another including said side walls and side edges engaging to support said spring finger means against circumferential displacement relative to said guide means.

9. In a drain cleaning apparatus comprising tubular guide means having an axis, snake means extending through said guide means, means to rotate said guide means about said axis, spring finger means rotatable with said guide means and including jaw means displaceable toward and away from said snake means between clamping and released positions relative thereto, and sleeve means received on said guide means and being axially displaceable relative thereto to actuate said spring finger means to displace said jaw means between said positions thereof, the improvement comprising: said spring finger means having axially opposite ends and axially extending side edges and said guide means having an outer surface including axially extending recess means receiving said spring finger means and having side walls receiving said side edges of said spring finger means therebetween, said jaw means being at one of said opposite ends of said spring finger means and extending radially toward said axis, the other of said ends of said spring finger means including tab means, tab slot means in said recess means and extending radially through said guide means and receiving said tab means, said spring finger means, said guide means and said sleeve means including means engaging with one another to alone support said spring finger means against axial and circumferential displacement relative to and radial separation from said guide means, said means engaging with one another including said tab means engaging said guide means in said tab slot means to support said spring finger means against axial displacement relative to said guide means, and said means engaging with one another further including said side walls and side edges engaging to support said spring finger means against circumferential displacement relative to said guide means.

10. Drain cleaning apparatus according to claim 9, wherein said guide means includes jaw opening means radially therethrough, said jaw means in said gripping and released positions extending into said jaw opening means, and said means engaging one another further including said jaw means engaging said guide means in said jaw opening means to support said spring finger means against axial displacement relative to said guide means.

11. Drain cleaning apparatus according to claim 10, wherein said tubular guide means has an inner surface, and said tab means includes a first tab portion spaced from said jaw means and extending radially through said tab slot means and a second tab portion extending axially from said first tab portion away from said jaw means and along said inner surface, said means engaging with one another including said second tab portion engaging said inner surface of said guide means to support said spring finger means against displacement radially outwardly of said guide means.

12. Drain cleaning apparatus according to claim 10, wherein said sleeve means is removably received on said guide means, said means engaging with one another including surface means on said sleeve means engaging said spring finger means to radially capture said spring finger means against said guide means, said sleeve means when removed from said guide means releasing said spring finger means for free radial separation from said guide means.

13. Drain cleaning apparatus according to claim 12, wherein said tubular guide means has an inner surface, and said tab means includes a first tab portion spaced from said jaw means and extending radially through said tab slot means and a second tab portion extending axially from said first tab portion away from said jaw means and along said inner surface, said means engaging with one another including said second tab portion engaging said inner surface of said guide means to support said spring finger means against displacement radially outwardly of said guide means.

14. Drain cleaning apparatus according to claim 9, wherein said sleeve means is removably received on said guide means, said means engaging with one another including surface means on said sleeve means engaging said spring finger means to radially capture said spring finger means against said guide means, said sleeve means when removed from said guide means releasing said spring finger means for free radial separation from said guide means.

15. Drain cleaning apparatus according to claim 1, wherein said sleeve means is removably received on said guide means, said means engaging with one another including surface means on said sleeve means engaging said spring finger means to radially capture said spring finger means against said guide means, said sleeve means when removed from said guide means releasing said spring finger means for free radial separation from said guide means.

16. Drain cleaning apparatus according to claim 15, wherein said spring finger means has axially opposite ends and axially extending side edges and said guide means has an outer surface including axially extending recess means receiving said spring finger means and having side walls receiving said side edges of said spring finger means therebetween, said means engaging with one another including said side walls and side edges engaging to support said spring finger means against circumferential displacement relative to said guide means.

17. A hand held drain cleaning apparatus comprising housing means having an axis, means for rotating said housing means about said axis, snake means coiled in said housing means about said axis, tubular guide means rotatable with and extending from said housing means coaxial with said axis and opening into said housing means for the passage of said snake means through said guide means, said guide means having an outer end with respect to said housing means, spring finger clamping means extending axially of said guide means in the direction from said outer end toward said housing means and having first leg means extending in said direction generally parallel to said axis and second leg means extending in said direction from said first leg means and outwardly at an inclined angle to said axis, said second leg means ending in jaw means extending radially inwardly toward said axis, said guide means including opening means radially therethrough for said jaw means, sleeve means removably received on said guide means in the direction from said outer end toward said housing means and having inner end means, said sleeve means being coaxial with said guide means and supported thereon for axial displacement therealong in opposite directions between first and second positions, retainer means removably mounted on said outer end of said guide means to removably retain said sleeve means on said guide means, said sleeve means in said first position axially overlying said first leg means of said spring finger clamping means with said inner end of said sleeve means facing said second leg means, said sleeve means being displaceable toward said housing means from said first position to said second position for said inner end means to displace said second leg means and move said jaw means radially inwardly to clamp against said snake means, and said spring finger means, said guide means and said sleeve means including means engaging with one another to alone support said spring finger means against axial and circumferential displacement relative to and radial separation from said guide means, said means engaging with one another including inner surface means on said sleeve means radially capturing said spring finger means between said guide means and sleeve means, whereby said sleeve means when removed from said guide means releases said spring finger means for free radial separation from said guide means.

18. Drain cleaning apparatus according to claim 17, wherein said housing means includes first and second separable housing portions forming an enclosure, and a snake cartridge removably received in said enclosure and containing said snake means.

19. Drain cleaning apparatus according to claim 18, wherein said cartridge includes end wall means extending across said axis and inclined with respect thereto.

20. Drain cleaning apparatus according to claim 17, wherein said means for rotating said housing means includes drive motor means having drive shaft means, and coupling means mounted on said housing means for engaging said housing means to said drive shaft means.

21. Drain cleaning apparatus according to claim 17, wherein said sleeve means has outer end means engaging said retainer means in said first position and said guide means includes stop means to limit displacement of said sleeve means toward said housing means.

22. Drain cleaning apparatus according to claim 17, wherein said sleeve means includes an inner sleeve member slidably and rotatably received on said guide means and an outer hand grippable sleeve member coaxial with and rotatable relative to said inner sleeve, and means interengaging said sleeve members against relative axial displacement.

23. Drain cleaning apparatus according to claim 22, wherein said hand grippable sleeve member includes annular skirt means surrounding and axially overlying said retainer means when said sleeve means is in said first position.

24. Drain cleaning apparatus according to claim 17, wherein said means engaging with one another includes axially extending recess means in said guide means receiving said spring finger means and having circumferentially spaced apart walls, and axially extending opposed side edges on said spring finger means between said walls, whereby said side edges and walls engage to support said spring finger means against circumferential displacement relative to said guide means.

25. A hand held drain cleaning apparatus comprising housing means having an axis, means for rotating said housing means about said axis, snake means coiled in said housing means about said axis, tubular guide means rotatable with and extending from said housing means coaxial with said axis and opening into said housing means for the passage of said snake means through said guide means, said guide means having an outer end with repsect to said housing means, spring finger clamping means extending axially of said guide means in the direction from said outer end toward said housing means and having first leg means extending in said direction generally parallel to said axis and second leg means extending in said direction from said first leg means and outwardly at an inclined angle to said axis, said second leg means ending in jaw means extending radially inwardly toward said axis, said guide means including opening means radially therethrough for said jaw means, sleeve means removably received on said guide means in the direction from said outer end toward said housing means and having inner end means, said sleeve means being coaxial with said guide means and supported thereon for axial displacement therealong in opposite directions between first and second positions, retainer means removably mounted on said outer end of said guide means to removably retain said sleeve means on said guide means, said sleeve means in said first position axially overlying said first leg means of said spring finger clamping means with said inner end of said sleeve means facing said second leg means, said sleeve means being displaceable toward said housing means from said first position to said second position for said inner end means to displace said second leg means and move said jaw means radially inwardly to clamp against said snake means, and said spring finger means, said guide means and said sleeve means including means engaging with one another to alone support said spring finger means against axial and circumferential displacement relative to and radial separation from said guide means, said means engaging with one another including slot means opening radially through said guide means and radial tab means on said firt leg means of said spring finger means extending into said slot means, said jaw means extending into said opening for said jaw means, and said tab means and jaw means engaging said guide means respectively in said slot means and said opening for said jaw means to support said spring finger means against axial displacement relative to said guide means.

26. Drain cleaning apparatus according to claim 25, wherein said means engaging with one another further includes axially extending recess means in said guide means receiving said spring finger means and having circumferentially spaced apart walls, and axially extending opposed side edges on said spring finger means between said walls, whereby said side edges and walls engage to support said spring finger means against circumferential displacement relative to said guide means.

27. Drain cleaning apparatus according to claim 17, and booster spring means radially between said spring finger clamping means and tubular guide means for biasing said second leg means radially outwardly of said guide means.

28. Drain cleaning apparatus according to claim 27, wherein said booster spring means has first and second leg means contiguous respectively with said first and second leg means of said spring finger clamping means.

29. Drain cleaning apparatus according to claim 17, wherein said means engaging with one another includes said inner end means of said sleeve means engaging said second leg means of said spring finger clamping means to support said spring finger means against radial separation from said guide means.

30. A hand held drain cleaning apparatus comprising housing means having an axis, means for rotating said housing means about said axis, snake means coiled in said housing means about said axis, tubular guide means rotatable with and extending from said housing means coaxial with said axis and opening into said housing means for the passage of said snake means through said guide means, said guide means having an outer end with respect to said housing means, spring finger clamping means extending axially of said guide means in the direction from said outer end toward said housing means and having first leg means extending in said direction generally parallel to said axis and second leg means extending in said direction from said first leg, means and outwardly at an inclined angle to said axis, said second leg means ending in jaw means extending radially inwardly toward said axis, said guide means including opening means radially therethrough for said jaw means, sleeve means removably received on said guide means in the direction from said outer end toward said housing means and having inner end means, said sleeve means being coaxial with said guide means and supported thereon for axial displacement therealong in opposite directions between first and second positions, retainer means removably mounted on said outer end of said guide means to removably retain said sleeve means on said guide means, said sleeve means in said first position axially overlying said first leg means of said spring finger clamping means with said inner end of said sleeve means facing said second leg means, said sleeve means being displaceable toward said housing means from said first position to said second position for said inner end means to displace said second leg means and move said jaw means radially inwardly to clamp against said snake means, and said spring finger means, said guide means and said sleeve means including means engaging with one another to alone support said spring finger means against axial and circumferential displacement relative to and radial separation from said guide means, said means engaging with one another including said inner end means of said sleeve means engaging said second leg means of said spring finger clamping means to support said spring finger means against radial separation from said guide means, and said means engaging with one another further including slot means opening radially through said guide means and radial tab means on said first leg means of said spring finger means extending into said slot means, said jaw means extending into said opening for said jaw means, and said tab means and jaw means engaging said guide means respectively in said slot means and said opening for said jaw means to support said spring finger means against axial displacement relative to said guide means.

31. Drain cleaning apparatus according to claim 30, wherein said means engaging with one another further includes axially extending recess means in said guide means receiving said spring finger means and having circumferentially spaced apart walls, and axially extending opposed side edges on said spring finger means between said walls, whereby said side edges and walls engage to support said spring finger means against circumferential displacement relative to said guide means.

32. Drain cleaning apparatus according to claim 31, wherein said means engaging with one another further includes axially extending tab means on said radial tab means engaging said guide means interiorly of said slot means to support said spring finger means against radial separation from said guide means.

33. Drain cleaning apparatus according to claim 32, wherein, with said sleeve means removed from said guide means, said finger means is free to pivot radially outwardly of said guide means relative to said slot means to facilitate withdrawal of said tab means radially outwardly of said slot means to separate said spring finger means from said guide means.

34. Dain cleaning apparatus according to claim 33, and booster spring means radially between said spring finger clamping means and tubular guide means for biasing said second leg means radially outwardly of said guide means.

35. Drain cleaning apparatus according to claim 34, wherein said booster spring means has first and second leg means contiguous respectively with said first and second leg means of said spring finger clamping means.

36. Drain cleaning apparatus according to claim 33, wherein said sleeve means includes an inner sleeve member slidably and rotatably received on said guide means and an outer hand grippable sleeve member coaxial with and rotatable relative to said inner sleeve, and means interengaging said sleeve members against relative axial displacement.

* * * * *

UNITED STATES PATENT AND TRADEMARK OFFICE

CERTIFICATE OF CORRECTION

PATENT NO. : 4,956,889

DATED : September 18, 1990

INVENTOR(S) : Karl L. Kirk

It is certified that error appears in the above-identified patent and that said Letters Patent is hereby corrected as shown below:

On the Title Page, Item [57] Abstract, line 5, "sanke" should read --- snake ---. Claim 25, line 42, "firt" should read --- first ---.

Signed and Sealed this

Thirty-first Day of December, 1991

*Attest:*

HARRY F. MANBECK, JR.

*Attesting Officer*

*Commissioner of Patents and Trademarks*